US012601523B2

(12) United States Patent
Tsai et al.

(10) Patent No.: US 12,601,523 B2
(45) Date of Patent: Apr. 14, 2026

(54) WATER HEATER RECOVERY TIME ESTIMATION

(71) Applicant: Haier US Appliance Solutions, Inc., Wilmington, DE (US)

(72) Inventors: Craig Iung-Pei Tsai, Louisville, KY (US); Paul Goodjohn, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 271 days.

(21) Appl. No.: 17/946,603

(22) Filed: Sep. 16, 2022

(65) Prior Publication Data

US 2024/0093906 A1 Mar. 21, 2024

(51) Int. Cl.

| | |
|---|---|
| ***F24H 9/00*** | (2022.01) |
| ***F24H 1/18*** | (2022.01) |
| ***F24H 9/20*** | (2022.01) |
| ***F24H 15/20*** | (2022.01) |
| ***F24H 15/223*** | (2022.01) |
| ***F24H 15/225*** | (2022.01) |
| ***F24H 15/37*** | (2022.01) |
| ***F24H 15/395*** | (2022.01) |
| ***F24H 15/414*** | (2022.01) |
| ***F24H 15/421*** | (2022.01) |

(52) U.S. Cl.
CPC ..... *F24H 9/0005* (2013.01); *F24H 1/185* (2013.01); *F24H 9/2014* (2013.01)

(58) Field of Classification Search
CPC ..... F24F 8/117–142; B01D 53/34
See application file for complete search history.

(56) References Cited

U.S. PATENT DOCUMENTS

| | | | | |
|---|---|---|---|---|
| 7,818,095 | B2 * | 10/2010 | Hotton | F24H 15/36 219/490 |
| 10,684,023 | B2 * | 6/2020 | Chaudhry | G05B 15/02 |
| 2013/0261812 | A1 * | 10/2013 | Roberts | F24H 9/2007 702/45 |
| 2019/0277537 | A1 * | 9/2019 | McCullough | F24H 15/225 |
| 2019/0391606 | A1 * | 12/2019 | Vaudreuil | G05D 23/303 |

FOREIGN PATENT DOCUMENTS

| | | |
|---|---|---|
| CN | 108204608 A | 6/2018 |
| CN | 108562049 B | 11/2019 |

* cited by examiner

*Primary Examiner* — Steven S Anderson, II
(74) *Attorney, Agent, or Firm* — Dority & Manning, P.A.

(57) ABSTRACT

A method of operating a water heater appliance includes activating a heating element of the water heater, whereby a volume of water in a tank of the water heater is heated and measuring electrical power drawn by the heating element of the water heater appliance while the heating element is activated to heat the volume of water. The method also includes determining a tank depletion status of the tank based on the measured electrical power drawn by the heating element. The method further includes estimating a recovery time based on the determined tank depletion status.

18 Claims, 4 Drawing Sheets

WATER HEATER RECOVERY TIME ESTIMATION

FIELD OF THE INVENTION

The present subject matter relates generally to water heater appliances and methods for estimating a recovery time of water heater appliances.

BACKGROUND OF THE INVENTION

Certain water heater appliances include a tank therein. Heating elements, such as gas burners, electric resistance elements, or induction elements, heat water within the tank during operation of such water heater appliances. In particular, the heating elements generally heat water within the tank to a predetermined temperature. The predetermined temperature is generally selected such that heated water within the tank is suitable for showering, washing hands, etc.

During operation, relatively cool water flows into the tank, and the heating elements operate to heat such water to the predetermined temperature. Thus, the volume of heated water available at the predetermined temperature is generally limited to the volume of the tank. Additionally, the volume of heated water available at the predetermined temperature may be less than the total volume of the tank, e.g., after a large draw or several draws in close succession, while the tank is recovering, e.g., heating the relatively cool water which flowed in to replace the hot water drawn out.

During such recovery time, operability of the hot water heater may be limited. For example, a user wishing to take a long, hot shower or to wash a large load of laundry may not have a sufficient volume of heated water available at the predetermined temperature to satisfactorily complete such tasks. Thus, the user may be interested to know when the water heater is recovered, such that the full range of uses are available, including uses which require a volume of water at the predetermined temperature which is close to the total volume of the tank or which is a majority of the total volume of the tank.

Accordingly, a water heater appliance that includes features for determining a recovery time for reheating or fully heating water within the tank to the predetermined temperature would be useful.

BRIEF DESCRIPTION OF THE INVENTION

Aspects and advantages of the invention will be set forth in part in the following description, or may be apparent from the description, or may be learned through practice of the invention.

In one exemplary embodiment, a method for operating a water heater appliance is provided. The water heater appliance includes a tank for storing a volume of water therein and a heating element configured to heat the volume of water in the tank. The method includes activating a heating element of the water heater, whereby a volume of water in a tank of the water heater is heated. The method also includes measuring electrical power drawn by the heating element of the water heater appliance while the heating element is activated to heat the volume of water. The method further includes determining a tank depletion status of the tank based on the measured electrical power drawn by the heating element and estimating a recovery time based on the determined tank depletion status.

In another exemplary embodiment, a water heater appliance is provided. The water heater appliance includes a tank for storing a volume of water therein and a heating element configured to heat the volume of water in the tank. The water heater appliance further includes a controller. The controller is configured for activating the heating element, whereby the volume of water in the tank of the water heater is heated. The controller is also configured for measuring electrical power drawn by the heating element of the water heater appliance while the heating element is activated to heat the volume of water. The controller is further configured for determining a tank depletion status of the tank based on the measured electrical power drawn by the heating element and estimating a recovery time based on the determined tank depletion status.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
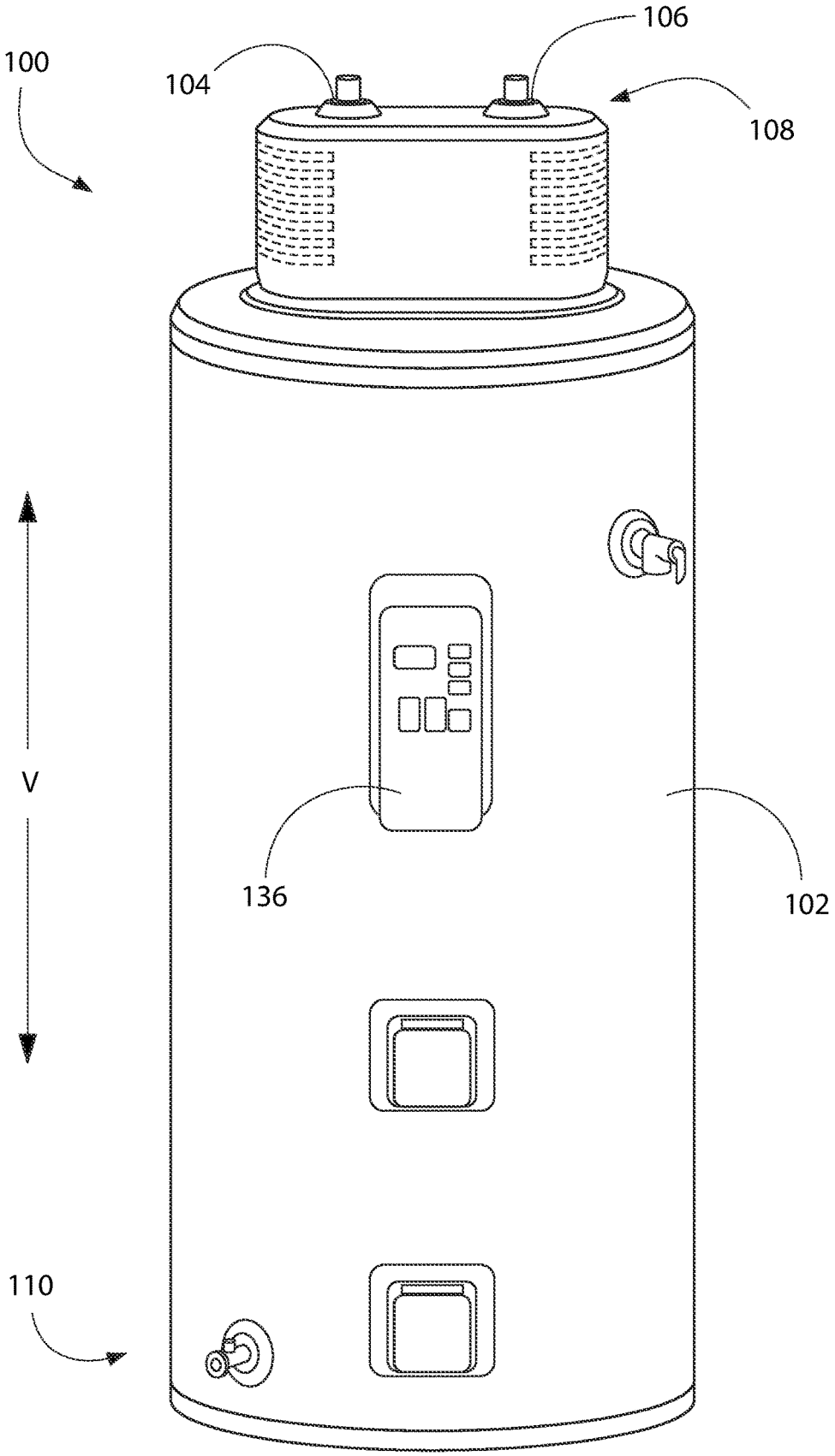
FIG. 1 provides a perspective view of a water heater appliance according to an exemplary embodiment of the present subject matter.

Reference now will be made in detail to embodiments of the invention, one or more examples of which are illustrated in the drawings. The detailed description uses numerical and letter designations to refer to features in the drawings. Like or similar designations in the drawings and description have been used to refer to like or similar parts of the disclosure. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise. The terms "upstream" and "downstream" refer to the relative direction with respect to fluid flow in a fluid pathway. For example, "upstream" refers to the direction from which the fluid flows, and "downstream" refers to the direction to which the fluid flows.

FIG. 1 provides a perspective view of a water heater appliance 100 according to an exemplary embodiment of the present subject matter. Water heater appliance 100 includes a casing 102. A tank 101 (FIG. 2) and heating elements 103 (FIG. 2) are positioned within casing 102 for heating water therein. Heating elements 103 may include a gas burner, a heat pump, an electric resistance element, a microwave element, an induction element, or any other suitable heating element or combination thereof. As will be understood by those skilled in the art and as used herein, the term "water" includes purified water and solutions or mixtures containing water and, e.g., elements (such as calcium, chlorine, and fluorine), salts, bacteria, nitrates, organics, and other chemical compounds or substances.

Water heater appliance 100 also includes a cold water conduit 104 and a hot water conduit 106 that are both in fluid communication with a chamber 111 (FIG. 2) defined by tank 101 within tank 101. As an example, cold water from a water source, e.g., a municipal water supply or a well, can enter water heater appliance 100 through cold water conduit 104 (shown schematically with arrow labeled $F_{cool}$ in FIG. 2). From cold water conduit 104, such cold water can enter chamber 111 of tank 101 wherein it is heated with heating elements 103 to generate heated water. Such heated water can exit water heater appliance 100 at hot water conduit 106 and be supplied to an end use point, e.g., such as a bath, shower, sink, or any other suitable feature.

Water heater appliance 100 extends longitudinally between a top portion 108 and a bottom portion 110 along a vertical direction V. Thus, water heater appliance 100 is generally vertically oriented. Water heater appliance 100 can be leveled, e.g., such that casing 102 is plumb in the vertical direction V, in order to facilitate proper operation of water heater appliance 100. It should be understood that water heater appliance 100 is provided by way of example only and that the present subject matter may be used with any suitable water heater appliance.

Figure 2:
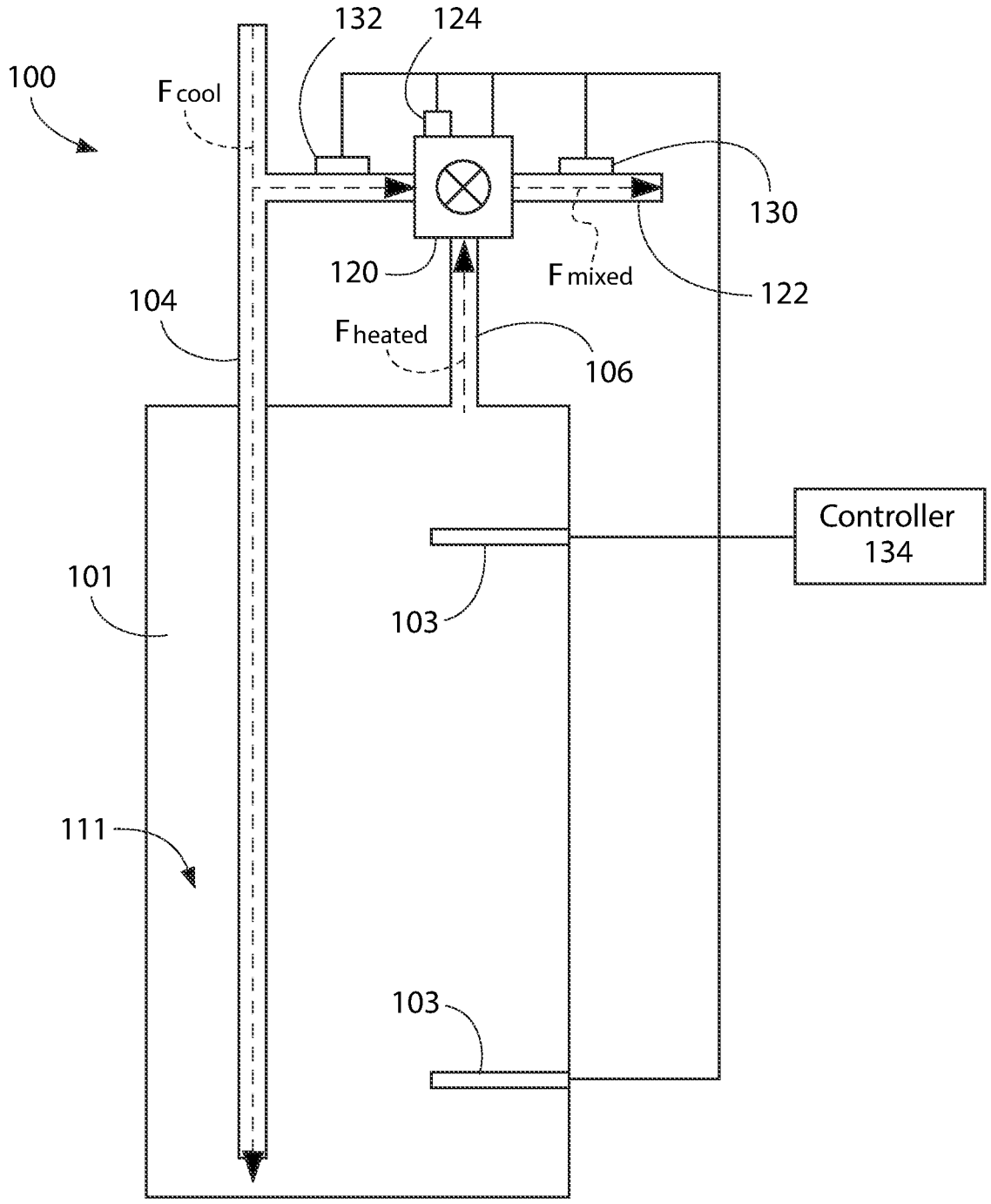
FIG. 2 provides a schematic view of certain components of the exemplary water heater appliance of FIG. 1.

FIG. 2 provides a schematic view of certain components of water heater appliance 100 according to one or more exemplary embodiments. As may be seen in FIG. 2, in the illustrated exemplary embodiment, water heater appliance 100 includes a mixing valve 120 and a mixed water conduit 122. Mixing valve 120 is in fluid communication with cold water conduit 104, hot water conduit 106, and mixed water conduit 122. As discussed in greater detail below, mixing valve 120 is configured for selectively directing water from cold water conduit 104 and hot water conduit 106 into mixed water conduit 122 in order to regulate a temperature of water within mixed water conduit 122.

Additional embodiments of the present disclosure may also include a water heater appliance 100 without the mixing valve 120 or the mixed water conduit. In embodiments where the mixing valve 120 and mixed water conduit 122 are not provided, the cold water conduit 104 may be connected directly to the tank 101 and only to the tank 101, e.g., not connected to the hot water conduit 106 other than through the chamber 111 of the tank 101, and the hot water conduit may also be connected only to the tank 101, e.g., not connected to the cold water conduit 104 other than through the chamber 111 of the tank 101. In such embodiments, it is to be understood that the cold water conduit 104 is still connected to a water supply, and the hot water conduit 106 is still connected to downstream use points or fixtures, e.g., dishwasher appliance, laundry appliance, sink, bathtub, etc., such that the foregoing description of the conduits being "only" connected to the tank in some embodiments is limited to the particular context of which components of the water heater appliance 100 are connected to each other.

Referring again to the particular example embodiment illustrated in FIG. 2, in embodiments where the mixing valve 120 is provided, the mixing valve 120 can selectively adjust between a first position and a second position. In the first position, mixing valve 120 can permit a first flow rate of relatively cool water from cold water conduit 104 (shown schematically with arrow labeled $F_{cool}$ in FIG. 2) into mixed water conduit 122 and mixing valve 120 can also permit a first flow rate of relatively hot water from hot water conduit 106 (shown schematically with arrow labeled $F_{heated}$ in FIG. 2) into mixed water conduit 122. In such a manner, water within mixed water conduit 122 (shown schematically with arrow labeled $F_{mixed}$ in FIG. 2) can have a first particular temperature when mixing valve 120 is in the first position. Similarly, mixing valve 120 can permit a second flow rate of relatively cool water from cold water conduit 104 into mixed water conduit 122 and mixing valve 120 can also permit a second flow rate of relatively hot water from hot water conduit 106 into mixed water conduit 122 in the second position. The first and second flow rates of the relatively cool water and relatively hot water are different such that water within mixed water conduit 122 can have a second particular temperature that is different from the first particular temperature when mixing valve 120 is in the second position. In such a manner, mixing valve 120 can regulate the temperature of water within mixed water conduit 122 and adjust the temperature of water within mixed water conduit 122 between the first and second particular temperatures.

It should be understood that, in certain exemplary embodiments, mixing valve 120 is adjustable between more positions than the first and second positions. In particular, mixing valve 120 may be adjustable between any suitable number of positions in alternative exemplary embodiments. For example, mixing valve 120 may be infinitely adjustable between and including a full cold position and a full hot position, in order to permit fine-tuning of the temperature of water within mixed water conduit 122.

Water heater appliance 100 also includes a position sensor 124. Position sensor 124 is configured for determining a position of mixing valve 120. Position sensor 124 can monitor the position of mixing valve 120 in order to assist with regulating the temperature of water within mixed water conduit 122. For example, position sensor 124 can determine when mixing valve 120 is in the first position or the second position in order to ensure that mixing valve 120 is properly or suitably positioned depending upon the temperature of water within mixed water conduit 122 desired or selected. Thus, position sensor 124 can provide feedback regarding the status or position of mixing valve 120.

It should be understood that in alternative exemplary embodiments, water heater appliance 100 need not include mixed water conduit 122. In such exemplary embodiments, mixing valve 120 can direct water into hot water conduit 106 in order to regulate a temperature of water within hot water conduit 106. Additionally, embodiments of the present invention may also include a water heater appliance without a mixing valve or a mixed water conduit, e.g., where the cold water conduit 104 and the hot water conduit 106 are each connected to the other only through the tank 101, as noted above.

Water heater appliance 100 also includes a mixed water conduit temperature sensor 130 and a cold water conduit temperature sensor 132. Mixed water conduit temperature sensor temperature sensor 130 is positioned on or proximate to mixed water conduit 122 and is configured for measuring a temperature of water within mixed water conduit 122. Mixed water conduit temperature sensor temperature sensor 130 is also positioned downstream of mixing valve 120. Cold water conduit temperature sensor 132 is positioned on or proximate to cold water conduit 104 and is configured for measuring a temperature of water within cold water conduit 104. Cold water conduit temperature sensor 132 is positioned upstream of mixing valve 120. In certain exemplary embodiments, mixed water conduit temperature sensor 130 and/or cold water conduit temperature sensor 132 may be positioned proximate to or adjacent to mixing valve 120.

Water heater appliance 100 further includes a controller 134 that is configured for regulating operation of water heater appliance 100. Controller 134 is in, e.g., operative, communication with heating elements 103, mixing valve 120, position sensor 124, and water conduit temperature sensors 130 and 132. Thus, controller 134 can selectively activate heating elements 103 in order to heat water within chamber 111 of tank 101. Similarly, controller 134 can selectively operate mixing valve 120 in order to adjust a position of mixing valve 120 and regulate a temperature of water within mixed water conduit 122.

Controller 134 includes memory and one or more processing devices such as microprocessors, CPUs or the like, such as general or special purpose microprocessors operable to execute programming instructions or micro-control code associated with operation of water heater appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 134 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 134 may be programmed to operate the water heater appliance 100 by executing instructions stored in memory. For example, the instructions may be software or any set of instructions that when executed by the processing device, cause the processing device to perform operations. Controller 134 can include one or more processor(s) and associated memory device(s) configured to perform a variety of computer-implemented functions and/or instructions (e.g. performing the methods, steps, calculations and the like and storing relevant data as disclosed herein). It should be noted that controllers 134 as disclosed herein are capable of and may be operable to perform any methods and associated method steps as disclosed herein.

Controller 134 can be positioned at a variety of locations. In the exemplary embodiment shown in FIG. 1, controller 134 is positioned within water heater appliance 100, e.g., as an integral component of water heater appliance 100. In alternative exemplary embodiments, controller 134 may be positioned away from water heater appliance 100 and communicate with water heater appliance 100 over a wireless connection or any other suitable connection, such as a wired connection.

The controller 134 may also include or be coupled to a user interface 136 (FIG. 1). The user interface 136 may comprise any suitable control or display that will allow a user to program, set, and adjust the functions and settings of the water heater appliance 100, as are generally described herein. In some exemplary embodiments, the user interface 136 may comprise a display interface, such as a touch screen display. In some exemplary embodiments, the user interface 136 may also or instead include mechanical buttons or switches for manipulating and programming the settings of the water heater appliance 100, including, for example, the setpoint temperature. In some exemplary embodiments, the user interface 136 may comprise or be part of a control panel for the water heater appliance 100. The user interface 136 may also be located remotely from the water heater appliance 100, and may be accessible through a computing device that is remote from the water heater appliance 100 or through a web-based interface.

Controller 134 may operate heating elements 103 to heat water within chamber 111 of tank 101. As an example, a user can select or establish a setpoint temperature for water within chamber 111 of tank 101, e.g., via the user interface 136 as described above, or the setpoint temperature for water within chamber 111 of tank 101 may be a default value. Based upon the setpoint temperature for water within chamber 111 of tank 101, controller 134 can selectively activate heating elements 103 in order to heat water within chamber 111 of tank 101 to the setpoint temperature for water within chamber 111 of tank 101. The setpoint temperature for water within chamber 111 of tank 101 can be any suitable temperature. For example, the setpoint temperature for water within chamber 111 of tank 101 may be between about one hundred and forty degrees Fahrenheit and about one hundred and eighty degrees Fahrenheit.

Controller 134 can also operate mixing valve 120 to regulate the temperature of water within mixed water conduit 122. For example, controller 134 can adjust the position of mixing valve 120 in order to regulate the temperature of water within mixed water conduit 122. As an example, a user can select or establish a setpoint temperature of mixing valve 120, or the setpoint temperature of mixing valve 120 may be a default value. Based upon the setpoint temperature of mixing valve 120, controller 134 can adjust the position of mixing valve 120 in order to change or tweak a ratio of relatively cool water flowing into mixed water conduit 122 from cold water conduit 104 and relatively hot water flowing into mixed water conduit 122 from hot water conduit 106. In such a manner, controller 134 can regulate the temperature of water within mixed water conduit 122.

The setpoint temperature of mixing valve 120 can be any suitable temperature. For example, the setpoint temperature of mixing valve 120 may be between about one hundred degrees Fahrenheit and about one hundred and twenty degrees Fahrenheit. In particular, the setpoint temperature of mixing valve 120 may be selected such that the setpoint temperature of mixing valve 120 is less than the setpoint temperature for water within chamber 111 of tank 101. In such a manner, mixing valve 120 can utilize water from cold water conduit 104 and hot water conduit 106 to regulate the temperature of water within mixed water conduit 122.

Figure 3:
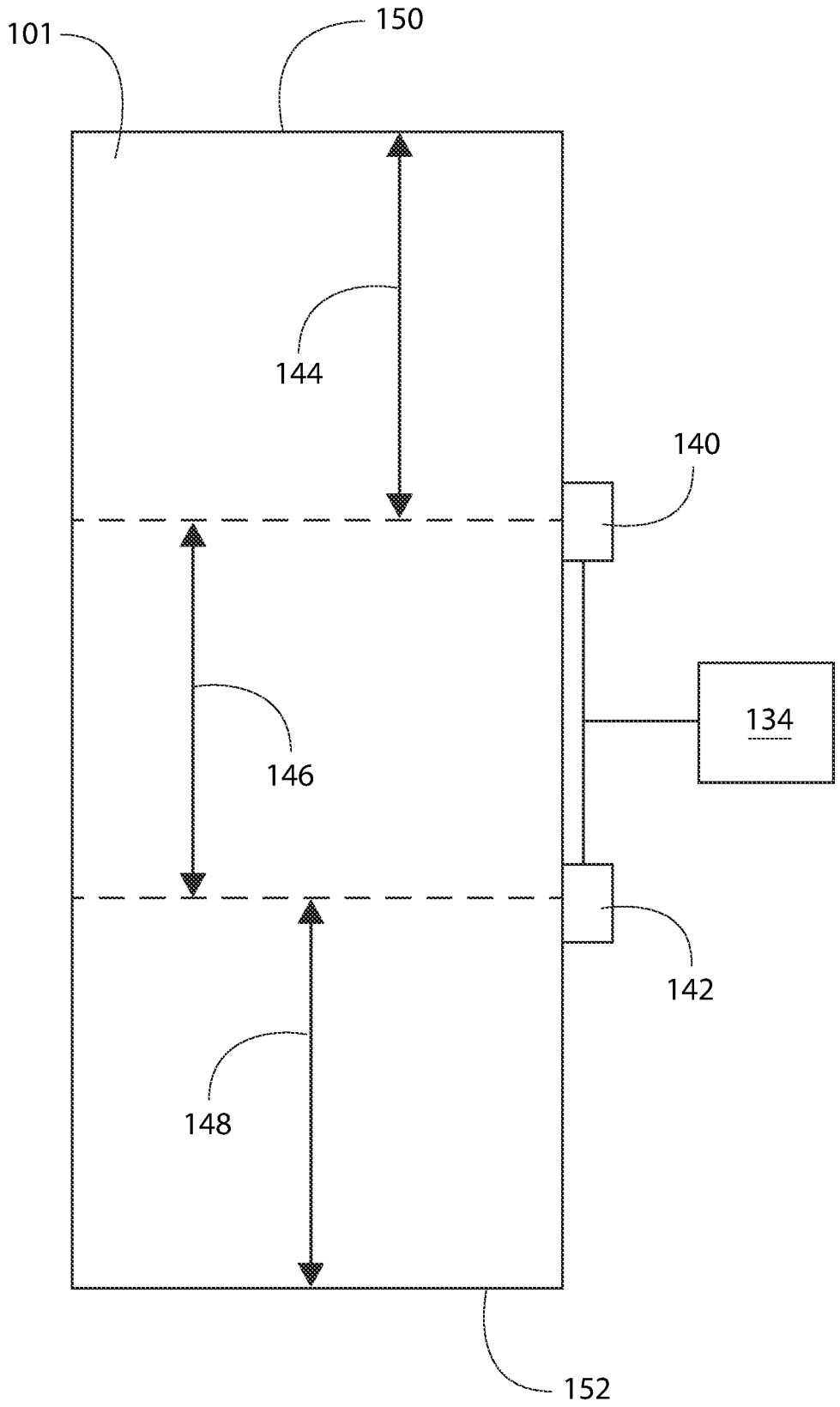
FIG. 3 illustrates a schematic view of certain components of a water heater appliance according to one or more exemplary embodiments of the present subject matter.

FIG. 3 illustrates a schematic view of the tank 101 of a water heater appliance according to one or more embodiments of the present disclosure. As illustrated in FIG. 3, the tank 101 extends along the vertical direction V from a top 150 to a bottom 152. The top 150 of the tank 101 may be positioned at or proximate to the top portion 108 (FIG. 1) of the water heater appliance 100, and the bottom 152 of the tank 101 may be positioned at or proximate to the bottom portion 110 (FIG. 1) of the water heater appliance, where "proximate to" the top portion 108 or bottom portion 110 includes closer to one than the other, such as "proximate to" the top portion 108 includes within the upper half of the water heater appliance 100, and "proximate to" the bottom portion 110 includes within the lower half of the water heater appliance 100. Thus, as described above, the cold water conduit may deliver relatively cold water at or proximate to the bottom 152 of the tank 101, and the water within the tank 101 may rise when and while it is heated, resulting in thermal stratification within the chamber 111, e.g., such that a temperature at the top 150 of the tank 101 is higher than a temperature at the bottom 152 of the tank 101. In particular, such thermal stratification may be more pronounced after a large draw of hot water, e.g., a large draw may include a volume of cold water that is a substantial portion (e.g., about 10% or greater) of the total tank 101 volume.

In some embodiments, e.g., as illustrated in FIG. 3, the water heater appliance 100 may include a plurality of temperature sensors mounted to the tank 101 of the water heater appliance 100. In such embodiments, each temperature sensor of the plurality of temperature sensors may be positioned and configured to measure a temperature of water within the tank 101, e.g., in the chamber 111 therein. The tank 101 may thereby include a plurality of zones defined by the plurality of temperature sensors. For example, in the particular embodiment illustrated in FIG. 3, the plurality of temperature sensors includes a lower temperature sensor 142 and an upper temperature sensor 140. Thus, the plurality of zones in the example embodiment illustrated in FIG. 3 includes a bottom zone 148 below the lower temperature sensor 142, a middle zone 146 between the temperature sensors 140 and 142, and a top zone 144 above the upper temperature sensor 140. Accordingly, under the effect of thermal stratification as described above, the top zone 144 may generally be the warmest zone and/or the quickest zone to recover after the tank 101 is depleted of hot water, while the bottom zone 148 may generally be the coolest zone and/or the slowest to recover after the tank 101 is depleted of hot water.

Additionally, as illustrated in FIG. 3, the upper temperature sensor 140 and the lower temperature sensor 142 may also be in communication with the controller 134, in a similar manner as described above with respect to sensors 130 and 132, e.g., whereby the controller receives signals from the upper temperature sensor 140 and the lower temperature sensor 142 via a wired or wireless connection, such as signals representative of or proportional to temperatures of water within the tank 101 measured by the upper temperature sensor 140 and the lower temperature sensor 142.

Figure 4:
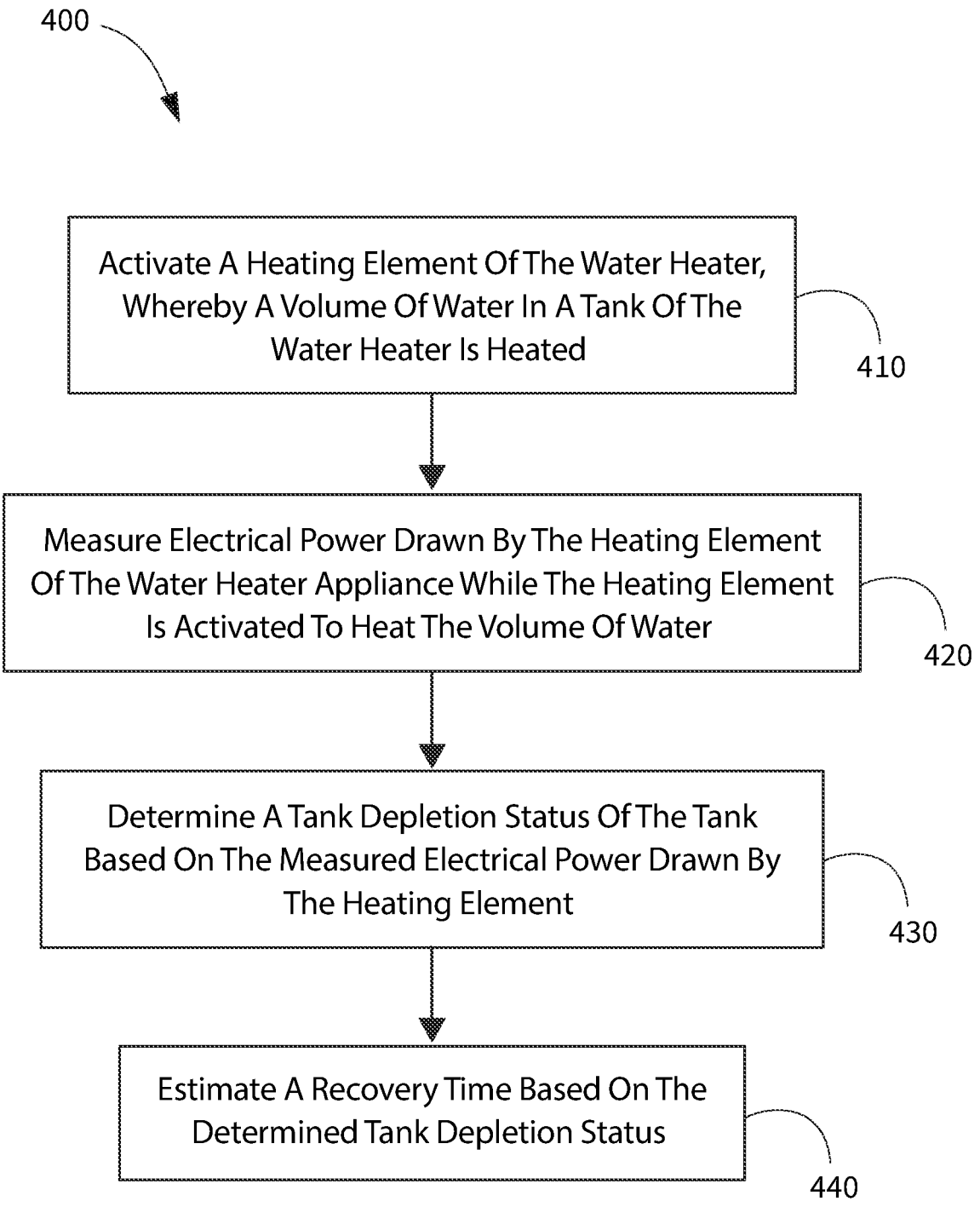
FIG. 4 illustrates a method for operating a water heater appliance according to one or more exemplary embodiments of the present subject matter.

FIG. 4 illustrates a method 400 for operating a water heater appliance according to an exemplary embodiment of the present subject matter. Method 400 can be used to operate any suitable water heater appliance. For example, method 400 may be utilized to operate water heater appliance 100 (FIG. 1), such as a water heater appliance with or without a mixing valve, and/or a water heater appliance with various heating elements, such as resistance rod heating elements as illustrated in FIG. 2, or a heat pump, a gas burner, or other suitable heating element, including combinations of two or more different types of heating elements. Controller 134 of water heater appliance 100 may be programmed to implement method 400.

In some embodiments, method 400 may include a step 410 of activating a heating element of the water heater. As a result of the activation of the heating element, a volume of water in a tank of the water heater is heated. As mentioned above, the heating element may take various forms or combinations of forms. Method 400 may also include a step 420 of measuring electrical power drawn by the heating element of the water heater appliance while the heating element is activated to heat the volume of water. For example, in some embodiments, the heating element may be a resistance heating element or a heat pump, such as a hybrid system including both a heat pump and one or more additional heating elements such as a resistance heating element. In embodiments where the heating element is or includes a heat pump, the electrical power that is measured may be the electrical power drawn by a fan or a compressor of the heat pump. In various embodiments, measuring the electrical power may include measuring a voltage and/or a current of the electrical power, such as a current drawn by one or more resistance heating elements.

As illustrated in FIG. 4, the operation of the water heater appliance may also include a step 430 of determining a tank depletion status of the tank based on the measured electrical power drawn by the heating element. For example, the larger the power draw, the more depleted the tank is, e.g., the larger the relative proportion of water below the setpoint temperature. In some embodiments, the depletion status may be a level or category of depletion, such as undepleted, mild depletion, severe depletion, or critical depletion.

Method 400 may further include a step 440 of estimating a recovery time based on the determined tank depletion status. For example, estimating the recovery time may include estimating the recovery time based on the determined tank depletion status and a current operating mode of the water heater appliance. The current operating mode of the water heater appliance may be, for example, one of vacation mode, standard mode, high demand mode, or other similar operating modes. The operating mode may generally correspond to an expected level or range of outflows from the water heater appliance, e.g., when the current operating mode is vacation mode, the expected outflows or hot water draws may be relatively small and/or infrequent, whereas when the current operating mode is high demand mode, the expected outflows or hot water draws may be relatively large and/or frequent.

In some embodiments, the estimated recovery time may be based on one or more current temperatures of the water in the tank of the water heater appliances, e.g., based on differences between the current temperature and the setpoint temperature. For example, such embodiments may include multiple temperatures measured by multiple temperature sensors at distinct locations in the tank, such as the temperatures in different zones of the tank. One such exemplary embodiment may include two temperature sensors, e.g., a lower temperature sensor and an upper temperature sensor, as described above with reference to FIG. 3. In such embodiments, the tank may include three zones, e.g., a bottom zone below the lower temperature sensor, a middle zone between the temperature sensors, and a top zone above the upper temperature sensor. Full recovery or an undepleted status of the tank may be or correspond to a minimal temperature difference between the temperature in the bottom zone of the tank and the setpoint temperature, such as when the temperature in the bottom zone of the tank is equal to or approximately equal to (e.g., within plus or minus ten percent of) the setpoint temperature.

Such embodiments may generally include estimating the recovery time by calculating the recovery time based on a difference between a temperature setpoint and a first temperature measured by a first temperature sensor of the plurality of temperature sensors, a difference between the temperature setpoint and a second temperature measured by a second temperature sensor of the plurality of temperature sensors, and a difference between the temperature setpoint and a weighted temperature derived from the first temperature and the second temperature. The weighted temperature may be, for example, a weighted average of the first temperature and the second temperature. Thus, for example, the estimated recovery time may be calculated as follows:

$$\text{RecTime}=M*[(\text{TankSP}-T2)*Top+(\text{TankSP}-(X*T2+Y*T1))*\text{Mid}+(\text{TankSP}-T1)*\text{Bot}]$$

where:

RecTime is the estimated recovery time;

M is a factor based on the current operating mode, this factor may be defined in a table for reference, e.g., in a lookup table;

TankSP is the temperature setpoint;

T1 is the temperature measured with the lower temperature sensor;

T2 is the temperature measured with the upper temperature sensor;

Top is a weighting factor relative to the top zone of the tank;

Mid is a weighting factor relative to the middle zone of the tank;

Bot is a weighting factor relative to the bottom zone of the tank;

X is a weight for the upper temperature; and

Y is a weight for the lower temperature.

The weights X and Y may be determined based on the depletion status of the tank, e.g., as was determined based on the measured electrical power. For example, when the tank depletion status is a mild depletion status, X may be ⅔ and Y may be ⅓, when the tank depletion status is a severe depletion status, X and Y may each be ½, and, when the tank depletion status is a critical depletion status, X may be ⅓ and Y may be ⅔. The weighting factors Top, Mid, and Bot may also be determined by the tank depletion status, such as when the tank depletion status is critical depletion status, the top zone will be heated more quickly than the middle zone or lower zone, such that the estimate may be more weighted towards the top zone for a critical depletion status. When the tank depletion status is severe or mild, the top zone of the tank may already be at or close to the setpoint temperature, such that the Top weighting factor may be less and the Bot and Mid weighting factors may be greater in such cases than when the determined depletion status is critical depletion status.

The recovery time may be estimated by calculating the time to reach undepleted status from the current depletion status, e.g., from the tank depletion status determined at step 430, such as in a single step or in multiple steps. For example, when the determined tank depletion status is a mild depletion status, estimating the recovery time may include estimating a time for the tank to reach an undepleted status from the mild depletion status, such as using the above formula with the weighting factors X and Y for mild depletion status. As another example, when the determined tank depletion status is a severe depletion status, estimating the recovery time may include estimating a first time for the tank to reach a mild depletion status from the severe depletion status, estimating a second time for the tank to reach an undepleted status from the mild depletion status, and summing the first time and the second time, and the sum of the first time and the second time is the estimated recovery time. For example, the above formula may be calculated multiple times, using the various weighting factors for each depletion status to estimate the first time and the second time. As yet another example, when the determined tank depletion status is a critical tank depletion status, estimating the recovery time may include estimating a first time to reach severe tank depletion status from critical tank depletion status, a second time to reach mild tank depletion status from severe tank depletion status, and a third time to reach an undepleted status from mild tank depletion status, wherein the estimated recovery time may then be the sum of the first time, the second time, and the third time.

Each example is provided by way of explanation, not limitation. In fact, it will be apparent to those skilled in the art that modifications and variations can be made without departing from the scope or spirit thereof. For instance, features illustrated or described as part of one embodiment may be used on another embodiment to yield a still further embodiment. Thus, it is intended that the present disclosure covers such modifications and variations as come within the scope of the appended claims and their equivalents. For example, some or all of the various steps of method 400 may be provided in additional combinations or sequences other than the illustrated example combination and sequence in FIG. 4.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a water heater appliance, the water heater appliance comprising a tank for storing a volume of water therein and a heating element configured to heat the volume of water in the tank, the method comprising:

activating a heating element of the water heater, whereby a volume of water in a tank of the water heater is heated;

measuring a first electrical power drawn by the heating element of the water heater appliance while the heating element is activated to heat the volume of water;

determining a first tank depletion status of the tank based on the first measured electrical power drawn by the heating element;

estimating a first recovery time based on the determined first tank depletion status, wherein estimating the first recovery time comprises determining a first operating mode factor based on a first current operating mode of the water heater appliance, and calculating the first recovery time based on the determined first tank depletion status and the first operating mode factor, wherein the first current operating mode of the water heater appliance corresponds to a first expected range of outflows from the water heater appliance;

measuring a second electrical power drawn by the heating element of the water heater appliance while the heating element is activated to heat the volume of water;

determining a second tank depletion status of the tank based on the second measured electrical power drawn by the heating element; and estimating a second recovery time based on the determined second tank depletion status, wherein estimating the second recovery time comprises determining a second operating mode factor based on a second current operating mode of the water heater appliance, and calculating the second recovery time based on the determined second tank depletion status and the second current operating mode factor, wherein the second current operating mode of the water heater appliance corresponds to a second expected range of outflows from the water heater appliance, and wherein the second expected range of outflows from the water heater appliance is different from the first expected range of outflows from the water heater appliance and the second operating mode factor is different from the first operating mode factor.

2. The method of claim 1, wherein the water heater appliance further comprises a plurality of temperature sensors mounted to the tank of the water heater appliance, each temperature sensor of the plurality of temperature sensors positioned and configured to measure a temperature of water within the tank, and wherein the tank comprises a plurality of zones defined by the plurality of temperature sensors.

3. The method of claim 2, wherein the plurality of temperature sensors comprises a lower temperature sensor and an upper temperature sensor, wherein the plurality of zones comprises a bottom zone below the lower temperature sensor, a middle zone between the temperature sensors, and a top zone above the upper temperature sensor.

4. The method of claim 2, wherein the recovery time is estimated based on a difference between a temperature setpoint and a first temperature measured by a first temperature sensor of the plurality of temperature sensors, a difference between the temperature setpoint and a second temperature measured by a second temperature sensor of the plurality of temperature sensors, and a difference between the temperature setpoint and a weighted temperature derived from the first temperature and the second temperature.

5. The method of claim 4, wherein the weighted temperature is derived from the first temperature and the second temperature by assigning a first weight to the first temperature and a second weight to the second temperature, and wherein the first weight and the second weight are each based on the determined tank depletion status.

6. The method of claim 1, wherein measuring the electrical power drawn by the heating element comprises measuring a voltage of the electrical power.

7. The method of claim 1, wherein measuring the electrical power drawn by the heating element comprises measuring a current of the electrical power.

8. The method of claim 1, wherein determining the tank depletion status comprises determining a mild depletion status, and wherein estimating the recovery time comprises estimating a time for the tank to reach an undepleted status from the mild depletion status.

9. The method of claim 1, wherein determining the tank depletion status comprises determining a severe depletion status, and wherein estimating the recovery time comprises estimating a first time for the tank to reach a mild depletion status from the severe depletion status, estimating a second time for the tank to reach an undepleted status from the mild depletion status, and summing the first time and the second time, wherein the sum of the first time and the second time is the estimated recovery time.

10. A water heater appliance, comprising:

a tank for storing a volume of water therein;

a heating element configured to heat the volume of water in the tank; and a controller, the controller configured for:

activating the heating element, whereby the volume of water in the tank of the water heater is heated;

measuring a first electrical power drawn by the heating element of the water heater appliance while the heating element is activated to heat the volume of water;

determining a first tank depletion status of the tank based on the first measured electrical power drawn by the heating element;

estimating a first recovery time based on the determined first tank depletion status, wherein the controller is configured for estimating the first recovery time by determining a first operating mode factor based on a first current operating mode of the water heater appliance, and calculating the first recovery time based on the determined first tank depletion status and the first current operating mode factor, wherein the first current operating mode of the water heater appliance corresponds to a first expected range of outflows from the water heater appliance;

measuring a second electrical power drawn by the heating element of the water heater appliance while the heating element is activated to heat the volume of water;

determining a second tank depletion status of the tank based on the second measured electrical power drawn by the heating element; and estimating a second recovery time based on the determined second tank depletion status, wherein the controller is configured for estimating the second recovery time by determining a second operating mode factor based on a second current operating mode of the water heater appliance, and calculating the second recovery time based on the determined second tank depletion status and the second current operating mode factor, wherein the second current operating mode of the water heater appliance corresponds to a second expected range of outflows from the water heater appliance, and wherein the second expected range of outflows from the water heater appliance is different from the first expected range of outflows from the water heater appliance and the second operating mode factor is different from the first operating mode factor.

11. The water heater appliance of claim 10, further comprising a plurality of temperature sensors mounted to the tank of the water heater appliance, each temperature sensor of the plurality of temperature sensors positioned and configured to measure a temperature of water in within the tank, and wherein the tank comprises a plurality of zones defined by the plurality of temperature sensors.

12. The water heater appliance of claim 11, wherein the plurality of temperature sensors comprises a lower temperature sensor and an upper temperature sensor, wherein the plurality of zones comprises a bottom zone below the lower temperature sensor, a middle zone between the temperature sensors, and a top zone above the upper temperature sensor.

13. The water heater appliance of claim 11, wherein the controller is configured for estimating the recovery time based on a difference between a temperature setpoint and a first temperature measured by a first temperature sensor of the plurality of temperature sensors, a difference between the temperature setpoint and a second temperature measured by a second temperature sensor of the plurality of temperature sensors, and a difference between the temperature setpoint and a weighted temperature derived from the first temperature and the second temperature.

14. The water heater of claim 13, wherein the controller is configured for deriving the weighted temperature from the first temperature and the second temperature by assigning a first weight to the first temperature and a second weight to the second temperature, and wherein the first weight and the second weight are each based on the determined tank depletion status.

15. The water heater appliance of claim 10, wherein the controller is configured for measuring the electrical power drawn by the heating element by measuring a voltage of the electrical power.

16. The water heater appliance of claim 10, wherein the controller is configured for measuring the electrical power drawn by the heating element by measuring a current of the electrical power.

17. The water heater appliance of claim 10, wherein determining the tank depletion status comprises determining a mild depletion status, and wherein the controller is configured for estimating the recovery time by estimating a time for the tank to reach an undepleted status from the mild depletion status.

18. The water heater appliance of claim 10, wherein determining the tank depletion status comprises determining a severe depletion status, and wherein the controller is configured for estimating the recovery time by estimating a first time for the tank to reach a mild depletion status from the severe depletion status, estimating a second time for the tank to reach an undepleted status from the mild depletion status, and summing the first time and the second time, wherein the sum of the first time and the second time is the estimated recovery time.

* * * * *